United States Patent [19]

Takashima et al.

[11] Patent Number: 4,460,557

[45] Date of Patent: Jul. 17, 1984

[54] STARTING PITCHES FOR CARBON FIBERS

[75] Inventors: Hiroaki Takashima, Kawasaki; Osamu Kato, Yokahama; Seiichi Uemura, Tokyo; Shunichi Yamamoto; Takao Hirose, both of Kamakura, all of Japan

[73] Assignee: Nippon Oil Co., Ltd., Tokyo, Japan

[21] Appl. No.: 441,670

[22] Filed: Nov. 15, 1982

[30] Foreign Application Priority Data

| | | | |
|---|---|---|---|
| Nov. 18, 1981 | [JP] | Japan | 56-183690 |
| Nov. 18, 1981 | [JP] | Japan | 56-183691 |
| Dec. 28, 1981 | [JP] | Japan | 56-209650 |
| Dec. 28, 1981 | [JP] | Japan | 56-209651 |

[51] Int. Cl.[3] ..... D01F 9/14

[52] U.S. Cl. ..... 423/447.1; 423/447; 208/22

[58] Field of Search ..... 423/447.1, 447.2, 447.4, 423/447.6, 447.7, 447.8; 208/22, 39, 40, 44; 264/29.2

[56] References Cited

U.S. PATENT DOCUMENTS 4,272,501 6/1981 Greskovich et al. ..... 423/447.1

FOREIGN PATENT DOCUMENTS 56-26009 3/1981 Japan ..... 423/447.1

1315940 5/1973 United Kingdom ..... 423/447.1

OTHER PUBLICATIONS

Cram et al., *Organic Chemistry,* McGraw-Hill, 1964, p. 725.

Marsh et al., "Fuel", vol. 59, pp. 517-519, Jul. 1980.

*Primary Examiner*—John Doll

*Assistant Examiner*—Steven Capella

*Attorney, Agent, or Firm*—Bucknam and Archer

[57] ABSTRACT

A process for the production of carbon fibers comprising heat treating a starting material, melt spinning the resulting precursor pitch, infusibilizing the pitch fibers and carbonizing or graphitizing the infusibilized pitch fibers, characterized in that the starting pitch is obtained by heat treating coal tar and/or coal liquefaction pitch at a specific temperature and a specific hydrogen pressure or by mixing coal tar and/or coal liquefaction tar with at least one nucleus-hydrogenated hydrocarbon of 2-3 rings in a specific mixing ratio and then heat treating the resulting mixture at a specific temperature and a specific pressure. In one embodiment, this invention relates to the starting pitch and carbon fibers obtained by said process.

7 Claims, No Drawings

STARTING PITCHES FOR CARBON FIBERS

This invention relates to a process for producing starting pitches for the production of carbon fibers therefrom.

At present, carbon fibers are produced mainly from polyacrylonitrile as the starting material. However, polyacrylonitrile as the starting material for carbon fibers is disadvantageous in that it is expensive, tends not to retain its fibrous shape when heated for stabilization and carbonization and is carbonized in a low yield.

In view of this, there have recently been reported many methods for producing carbon fibers from coal tar or pitch. However, such carbon fibers raise a problem that they have low tensile strength as compared with those produced from polyacrylonitrile. Thus, if there is found a method for solving this problem and further improving the coal tar- or pitch-derived carbon fibers in tensile modulus, this method will render it possible to produce carbon fibers having high tensile strength and tensile modulus at a low cost from coal tar or pitch.

On one hand, coal tar contains carbon black-like, quinoline-insoluble and infusible substances. These undesirable substances will cause non-uniformity of the resulting heat treated coal tar when the coal tar is melt spun, thereby not only degrading the spinnability of the heat treated coal tar but also having adverse effects on the tensile strength and tensile modulus of the resulting carbon fibers. Even if such coal tar from which the quinoline-insoluble infusible substances have previously been removed is heat treated in an attempt to produce a heat treated pitch suitable to be melt spun (such a heat treated pitch being hereinafter referred to as a "precursor pitch)", it will produce quinoline-insoluble high molecular weight ingredients.

On the other hand, it has recently been reported a method for producing carbon fibers having improved tensile modulus and tensile strength, which comprises heat treating a commercially available petroleum pitch to obtain a pitch containing optically anisotropic liquid crystals (the thus obtained pitch being precursor pitch as previously defined), melt spinning the thus obtained precursor pitch to obtain precursor pitch fibers, infusibilizing (making infusible) the pitch fibers so obtained and then carbonizing or further graphitizing the thus obtained pitch fibers to obtain the carbon fibers (Japanese Pat. Appln. Laid-Open Gazette 49-19127). However, it depends on various factors whether or not pitch any form liquid crystals therein. In addition, the resulting liquid crystals will greatly depend for their structure, softening point, viscosity and other properties on the pitch used as the starting material. The Japanese Laid-Open Gazette 49-19127 discloses a method for producing a precursor pitch, however, it does not refer to anything about a starting pitch for producing a precursor pitch of good quality therefrom. As mentioned before, it depends greatly on a starting pitch whether or not a precursor pitch of good quality may be obtained from it. If a very desirable starting pitch is obtained, then it will be possible to produce from it carbon fibers having excellent tensile modulus and tensile strength. Therefore, it is an important object of this invention to provide such a very desirable starting pitch. For example, a commercially available petroleum pitch will produce quinoline-insoluble high molecular weight ingredients when it is heat treated to prepare a precursor pitch therefrom.

More particularly, when coal tar and commercially available pitches are heat treated, they will cause both thermal decomposition and polycondensation whereby the low molecular weight ingredients gradually form quinoline-insoluble high molecular weight ones. Further, the high molecular weight ingredients so formed will, in turn, form further high molecular weight ones, accompanied with an increase in softening point of the pitches. If these quinoline-insoluble ingredients are similar to the carbon black-like substances in coal tar, they will have adverse effects in the spinning and its subsequent steps as mentioned above. In addition, even if the quinoline-insoluble ingredients are those which are different from the carbon black-like substances, the existence of the quinoline-insoluble substances in a large amount and the increase in softening point in the pitches will have adverse effects in the melt spinning step. More particularly, for melt spinning the precursor pitches, it is necessary to raise the spinning temperature to such an extent that the pitches have a viscosity sufficient to be melt spun. Thus, if the precursor pitches have too high a softening point, then the spinning temperature must naturally be increased with the result that the quinoline-insoluble ingredients form further high molecular weight ones, the pitches cause their pyrolysis with light fraction gases being evolved thereby rendering it impossible to obtain homogeneous pitches and carry out melt spinning of the pitches practically.

As is seen from the above, it is necessary that the precursor pitches have a comparatively low softening point and a viscosity suitable to enable them to be spun. Furthermore, the precursor pitches must not be such that they contain a substantial amount of volatile ingredients at the time of spinning and carbonization.

For this reason, the quinoline-insoluble ingredients are removed by filtration under a pressure, extraction with a solvent, or other suitable means to prepare precursor pitches for producing carbon fibers (Japanese Pat. Appln. Laid-Open Gazettes 47-9805, 50-142820, 55-1342 and 55-5954). However, the methods disclosed in these publications are not desirable from the economical point of view since they require complicated equipment and cause an increased cost.

It is an object of this invention to provide a process for producing a starting pitch which will easily form a precursor pitch having a comparatively low softening point.

It is another object to provide such a starting pitch.

According to the preferred embodiment, there is used, as the starting pitch, an excellent pitch which will not produce quinoline-insoluble high-molecular-weight ingredients when heated for preparing the precursor pitch.

The present inventors made substantial studies in an attempt to obtain such a starting excellent pitch and, as a result of their studies, they obtained a starting excellent pitch. More particularly, they found a starting pitch which will inhibit the production of high molecular weight ingredients, prevent an increase in softening point and be able to have a composition allowing the aromatic planes to be easily arranged in order in the step of preparing precursor pitches.

After their close research, the present inventors also found that pitches which are the most suitable as the material for said excellent starting pitch may be obtained if coal tar or coal liquefaction pitch is heat treated without the addition of a hydrogenating catalyst under certain extremely limited heat treating conditions.

The starting pitches of this invention which may be used in a method comprising heat treating a starting pitch to obtain a precursor pitch, melt spinning the thus obtained precursor pitch, infusibilizing the thus spun pitch, carbonizing the thus infusibilized pitch and, if desired, graphitizing the thus carbonized pitch to obtain carbon fibers having high tensile modulus and high tensile strength, may be obtained (A) by heat treating coal tar and/or coal liquefaction pitch at a temperature of 400°-500° C. under a hydrogen pressure of at least 20 kg/cm$^2$.G or (B) mixing (1) coal tar and/or coal liquefaction pitch with (2) at least one nucleus-hydrogenated aromatic hydrocarbon of 2-3 rings in a specific mixing ratio to obtain a mixture and then heat treating the thus obtained mixture.

The coal liquefaction pitch used in this invention is a pitch-like substance boiling at not lower than 200° C. obtained from depolymerization products produced by the use of a known method for coal liquefaction comprising treating various kinds of coal in a hydrocarbon solvent at 350°-500° C. under a hydrogen pressure of usually 10-500 kg/cm$^2$.G in the presence or absence of a catalyst for hydrogenation.

In one aspect of this invention (the former case (A)), the starting pitch may be obtained by heat treating coal tar and/or coal liquefaction pitch at a temperature of 400°-500° C., preferably 405°-450° C., under a hydrogen pressure of at least 20 kg/cm$^2$.G, preferable 20-350 kg/cm$^2$.G and more preferably 50-300 kg/cm$^2$.G. The heat treatment of such tar or pitch at a temperature of lower than 400° C. will result in producing a starting pitch which will produce a large amount of quinoline-insoluble ingredients when subjected to mesophase formation for obtaining precursor pitch, and will therefore tend to cause troubles such as coking, phase separation and a raise in softening point in the step of melt spinning with the undesirable result that the resulting carbon fibers have inferior performance. On the other hand, the heat treatment of such coal tar or pitch at a temperature of higher than 500° C. will raise a problem as to the coking thereof and the like, thereby rendering the production of a desired starting pitch difficult.

In another aspect of this invention (the latter case (B)), the starting pitch may be obtained by mixing (1) coal tar and/or coal liquefaction pitch with (2) at least one nucleus-hydrogenated aromatic hydrocarbon of 2-3 rings in a mixing ratio by volume of 1:0.1-2, preferable 1:0.2-1.5 and the heat treating the resulting mixture at 370°-480° C., preferably 390°-460° C. The use of a heat treating temperature of lower than 370° C. will cause the reaction to proceed slowly thereby uneconomically taking a long time to complete the reaction, while the use of a heat treating temperature of higher than 480° C. will undesirably raise a problem as to coking and the like.

In either case (A) or (B), the time for the heat treatment is selected depending on the heat treating temperature used and it is in the range of usually 15 minutes to 20 hours and preferably 30 minutes to 10 hours.

After the heat treatment, the precursor pitch so obtained may preferably be subjected to distillation or the like to remove the light fraction if necessary.

The coal tar used in this invention may be a low-temperature tar or a high-temperature tar. However, such tars from which the quinoline-insoluble ingredients have been removed, are preferred. In particular, high-temperature tars which have been freed of the quinoline-insoluble ingredients, are preferred.

The preferable nucleus-hydrogenated aromatic hydrocarbons of 2-3 rings used in the second aspect of this invention include naphtalene, indene, biphenyl, acenaphtylene, anthracene, phenanthren and their $C_{1-3}$ alkyl-substituted compounds, in each of which at least a part (10-100%, preferably 10-70%) of the aromatic nuclei has been hydrogenated. More specifically, they include decalin, methyldecalin, tetralin, methyltetralin, dimethyltetralin, ethyltetralin, isopropyltetralin, indane, decahydrobiphenyl, acenaphthene, methylacenaphthene, tetrahydroacenaphthene, dihydroanthracene, methylhydroanthracene, dimethylhydroanthracene, ethylhydroanthracene, tetrahydroanthracene, hexahydroanthracene, octahydroanthracene, dodecahydroanthracene, tetradecahydroanthracene, dihydrophenanthrene, methyldihydrophenanthrene, tetrahydrophenanthrene, hexahydrophenanthrene, octahydrophenanthrene, dodecahydrophenanthrene, tetradecahydrophenanthrene. Particularly preferred are nucleus-hydrogenated aromatic hydrocarbons obtained from bicyclic or tricyclic condensed aromatic hydrocarbons. The nuclei-hydrogenated aromatic hydrocarbons may be singly or in combination.

The starting pitches of this invention may be heat treated to obtain a satisfactory precursor pitch having a composition allowing the aromatic planes to be easily arranged in order, while inhibiting the production of quinoline-insoluble high molecular weight ingredients and preventing an increase in softening point of the pitch in the step of preparing precursor pitches. The thus prepared precursor pitches will be able to produce therefrom carbon fibers having very excellent tensile modulus and tensile strength.

The starting pitches of this invention may be treated to produce carbon fibers therefrom by the use of a known method. More particularly, they are heat treated to obtain a precursor pitch which is melt spun, infusibilized, carbonized or further graphitized to obtain carbon fibers.

The heat treatment of the starting pitch for obtaining a precursor pitch therefrom is effected at a temperature of usually 340°-450° C., preferably 370°-420° C., and an atmospheric to reduced pressure under a stream of an inert gas such as nitrogen. The time for the heat treatment may vary depending on the conditions such as the temperature used and the amount of inert gas used, and it is in the range of usually 1-50 hours, preferably 3-20 hours. The amount of inert gas used is preferably in the range of 0.7-5.0 scfh/lb pitch.

The precursor pitches may be melt spun by an extruding, centrifugal, spraying or like method.

The pitch fibers obtained by melt spinning are then infusibilized in an oxidizing atmosphere. The oxidizing gases used herein include oxygen, ozone, air, nitrogen oxides, halogens and sulphurous acid gas. These oxidizing gases may be used single or in combination. The infusibilizing treatment is effected at such a temperature that the pitch fibers, that is the melt spun pitch, are neither softened nor deformed. The temperature for the infusibilizing treatment may be in the range of 20°-360° C., preferably 20°-300° C., for example. The time for this treatment is usually in the range of 5 minutes to 10 hours.

The pitch fibers as infusibilized are then carbonized or further graphitized in an inert gas atmosphere to obtain carbon fibers. The carbonization is effected usually at 800°–2500° C. and the time therefor is in the range of 0.5 minutes to 10 hours. The further graphitization is effected at 2500°–3500° C. for usually one second to one hour.

When the material to be treated is infusibilized, carbonized or graphitized, some load or tension may be applied to said material in order to prevent the shrinkage, deformation or the like thereof.

This invention will be better understood by the following non-limitative Examples and Comparative Examples.

EXAMPLE 1

One hundred and fifty (150) ml of a high-temperature tar (the properties thereof being as shown in Table 1) from which the quinoline-insoluble ingredients had been removed (the remaining material being hereinafter referred to as a "tar QS portion") were introduced into a 300-ml autoclave provided with an agitator. The "tar QS portion" so introduced into the autoclave was heated at a temperature-raising rate of 3° C./min. to 440° C. under an initial hydrogen pressure of 100 kg/cm$^2$.G and maintained at this temperature for 3 hours, after which the heating was stopped and the resulting liquid product cooled to room temperature. The liquid product so obtained was distilled at 250° C./1 mmHg to remove the light fraction so as to obtain a starting pitch in a yield of 40 wt.%. The thus obtained starting pitch had a softening point of 70° C. and a 3% content of quinoline-insoluble ingredients.

Then, 30 g of said starting pitch were heat treated at 400° C. under agitation for 10 hours while passing nitrogen at a flow rate of 600 ml/min. to the pitch, thereby to obtain a precursor pitch having a softening point of 290° C. and a 46 wt.% content of quinoline-insoluble ingredients. The yield of the thus obtained precursor pitch was 50 wt.%. The precursor pitch was melt spun at 345° C. by the use of a spinner having 0.3 mm-diameter nozzles and L/D=2 to obtain pitch fibers of 13$\mu$ in diameter which were then infusibilized, carbonized and graphitized under the following treating conditions.

Infusibilizing conditions: Raised at 3° C./min. to 200° C., then at 1° C./min. to 300° C. and maintained at 300° C. for 30 minutes in air.

Carbonizing conditions: Raised at 5° C./min. to 1000° C. and maintained at this temperature for 30 minutes in a nitrogen atmosphere.

Graphitizing conditions: Raised at 25° C./min. to 2500° C. in an argon stream.

The resulting carbon fibers had an 11$\mu$ diameter, a tensile strength of 250 kg/mm$^2$ and a tensile modulus of 40 ton/mm$^2$.

TABLE 1

| Properties of High-Temperature Tar | |
|---|---|
| Density | 1.18 |
| Carbon content (%) | 91.3 |
| Hydrogen content (%) | 5.1 |
| Sulphur content (%) | 1.2 |
| Nitrogen content (%) | 0.7 |
| Ashes content (%) | 0.03 |
| Toluene-insoluble ingredients (%) | 9.1 |
| Viscosity* mole-sec at 60° C. | 680 |

*Measured by Redwood viscosimeter.

COMPARATIVE EXAMPLE 1

One hundred and fifty (150) ml of the same tar QS portion as used in Example 1 were charged into a 300-ml autoclave provided with an agitator, heated at 3° C./min. to 300° C. under an initial hydrogen pressure of 100 kg/cm$^2$.G and then maintained at this temperature for 3 hours, after which the heating was stopped and the resulting liquid product cooled to room temperature.

The thus obtained liquid product was distilled at 250° C./1 mmHg to distill of the light fraction thereby obtaining a starting pitch in a yield of 60 wt.%. The starting pitch so obtained had a softening point of 58° C. and none (0%) of quinoline-insoluble ingredients.

Then, 30 g of the starting pitch were heat treated at 400° C. under agitation for 10 hours while pressing nitrogen at a flow rate of 600 ml/min. to the pitch, thereby to obtain a precursor pitch in a yield of 40 wt.%. The thus obtained precursor pitch had a softening point of 315° C., 53 wt.% of quinoline-insoluble ingredients and 70% of mesophase portion. It was attempted to melt spin this precursor pitch in the same manner as in Example 1, however, it was impossible to effect uniform spinning.

EXAMPLE 2

One hundred and fifty (150) ml of coal liquefaction pitch (having the properties shown in Table 2) were charged into a 300-ml autoclave provided with an agitator, heated at a rate of 3° C./min. to 430° C. under an initial hydrogen pressure of 100 kg/cm$^2$.G and then maintained at this temperature for 2.5 hours, after which the heating was stopped and the resulting liquid product cooled to room temperature. The liquid product so obtained was distilled at 250° C./1 mmHg to distill off the light fraction thus obtaining a starting pitch. The softening point, content of quinoline-insoluble ingredients and yeild of the thus obtained starting pitch were 120° C., 15 wt.% and 62 wt.%, respectively.

Then, 30 g of said starting pitch were heat treated to 400° C. under agitation for 8 hours while passing nitrogen at a flow rate of 600 ml/min. to the pitch, thus to obtain in a yield of 50 wt.% a precursor pitch having a softening point of 290° C. and 46 wt.% of quinoline-insoluble ingredients. The thus obtained precursor pitch was melt spun at 345° C. by the use of a spinner having 0.3 mm-diameter nozzles and L/D=2 thus to obtain 13 $\mu$-diameter pitch fibers which were infusibilized, carbonized and graphitized under the same treating conditions as in Example 1 to obtain carbon fibers.

The thus obtained carbon fibers had an 11$\mu$ diameter, a tensile strength of 250 kg/mm$^2$ and a tensile modulus of 40 ton/mm$^2$.

TABLE 2

| Properties of Coal Liquefaction Pitch | |
|---|---|
| Density | 1.17 |
| Carbon content (%) | 87.5 |
| Hydrogen content (%) | 6.5 |
| Sulphur content (%) | 0.5 |
| Nitrogen content (%) | 1.1 |
| Ashes content (%) | 0.1 |
| Benzene-insoluble ingredients (%) | 34.3 |
| Softening point (Hg method) (°C.) | 83 |

COMPARATIVE EXAMPLE 2

One hundred and fifty (150) ml of the same coal liquefaction pitch as used in Example 2 were charged into a 300-ml autoclave provided with an agitator, heated at 3° C./min. to 300° C. at an initial hydrogen pressure of 200 kg/cm$^2$.G and then maintained at this temperature for 3 hours, after which the heating was stopped and the resulting liquid product cooled to room temperature. The thus obtained liquid product was distilled at 250° C./1 mmHg to distil the light fraction thus obtaining a starting pitch in a yield of 85 wt.%. The starting pitch had a softening point of 123° C. and 16% of quinoline-insoluble ingredients.

Then, 30 g of this starting pitch were heat treated at 400° C. under agitation for 8 hours while passing nitrogen at 600 ml/min. to the pitch, thereby to obtain a precursor pitch having a softening point of 315° C., 53 wt.% of quinoline-insoluble ingredients and 74% of mesophase portion. The thus obtained precursor pitch was attempted to be melt spun in the same manner as in Example 2, however, it was impossible to carry out uniform spinning.

EXAMPLE 3

Fifty (50) parts by volume of the same "tar QS portion" as used in Example 1 were mixed with 50 parts by volume of tetralin to form a mixture which was heat treated at 440° C. and 20 kg/cm$^2$.G for 3 hours and then distilled at 250° C./1.0 mmHg to distil off the light fraction thereby obtaining a starting pitch having a softening point of 55° C. and none (0%) of quinoline-insoluble ingredients in a yield of 53 wt.%.

Then, 30 g of the thus obtained starting pitch were heat treated at 400° C. under agitation for 10 hours while passing nitrogen at a flow rate of 600 ml/min. to the pitch, to obtain a precursor pitch in a yield of 45%. The thus obtained precursor pitch had a softening point of 280° C., 38 wt.% of quinoline-insoluble ingredients and 65% of mesophase portion. This precursor pitch was melt spun at 335° C. by the use of a spinner having 0.3 mm-diameter nozzles and L/D=2 thereby to obtain pitch fibers of 13$\mu$ in diameter which were then infusibilized, carbonized and graphitized under the same treating conditions as used in Example 1 thereby to carbon fibers having an 11$\mu$ diameter, a tensile strength of 240 kg/mm$^2$ and a tensile modulus of 38 ton/mm$^2$.

COMPARATIVE EXAMPLE 3

One hundred and fifty (150) ml of the same "tar QS portion" as used in Example 1 were heat treated at 440° C. and 15 kg/cm$^2$.G for 3 hours and then distilled at 250° C./1.0 mmHg to distil off the light fraction thereby obtaining a starting pitch in a yield of 50 wt.%. The thus obtained starting pitch had a softening point of 85° C. and 15% quinoline-insoluble ingredients.

Thereafter, 30 g of this starting pitch were heat treated at 400° C. under agitation for 7 hours while passing nitrogen at 600 ml/min. to the pitch, thereby to obtain a precursor pitch in a yield of 52 wt.%. The precursor pitch so obtained was melt spun, infusibilized, carbonized and graphitized in this same manner as in Example 3 thereby to obtain carbon fibers.

The thus obtained carbon fibers has a 12$\mu$ diameter, a tensile strength of 110 kg/mm$^2$ and a tensile modulus of 15 ton/mm$^2$.

EXAMPLE 4

Fifty (50) parts by volume of coal liquefaction pitch (having the properties shown in Table 2) were mixed with 50 parts by volume of tetralin to form a mixture which was then heat treated at 410° C. and 20 kg/cm$^2$.G for one hour. The pitch so heat treated was distilled at 250° C./1.0 mmHg to distill off the light fraction to obtain a starting pitch in a yield of 53 wt.%. The starting pitch so obtained had a softening point of 153° C. and 10 wt.% of quinoline-insoluble ingredients.

Thereafter, 30 g of this starting pitch were heat treated at 400° C. under agitation for 5 hours while passing nitrogen at a flow rate of 600 ml/min. to the pitch, thereby to obtain a precursor pitch in a yield of 45 wt.%. The thus obtained precursor pitch had a softening point of 282° C., 35 wt.% of quinoline-insoluble ingredients and 72% of mesophase portion. This precursor pitch was melt spun at 335° C. by the use of a spinner having 0.3 mm-diameter nozzles and L/D=2 to obtain pitch fibers having a 13$\mu$ diameter which were then infusibilized, carbonized and graphitized under the same treating conditions as used in Example 1 thereby to obtain carbon fibers having an 11$\mu$ diameter, a tensile strength of 240 kg/mm$^2$ and a tensile modulus of 38 ton/mm$^2$.

COMPARATIVE EXAMPLE 4

One hundred and fifty (150) ml of the same coal liquefaction pitch as used in Example 2 were heat treated at 415° C. and 15 kg/cm$^2$.G for 3 hours. The pitch so heat treated was distilled at 250° C./1.0 mmHg to distil off the light fraction thereby obtaining a starting pitch in a yield of 60 wt.%. The starting pitch so obtained had a softening point of 179° C. and 15 wt.% of quinoline-insoluble ingredients.

Then, 30 g of this starting pitch were heat treated at 400° C. under agitation for 5 hours while passing nitrogen at a flow rate of 600 ml/min. to the pitch, thereby to obtain a precursor pitch in a yield of 52 wt.%. The thus obtained precursor pitch had a softening point of 330° C., 48 wt.% of quinoline-insoluble ingredients and 98% of mesophase portion. This precursor pitch was melt spun, infusibilized carbonized and graphitized to obtain carbon fibers.

The thus obtained carbon fibers were 12$\mu$ in diameter and had a tensile strength of 110 kg/mm$^2$ and a tensile modulus of 15 ton/mm$^2$.

EXAMPLE 5

Seventy-five (75) ml of the same "tar QS portion" as used in Example 1 and 75 ml of the same coal liquefaction pitch as used in Example 2 were charged into a 300-ml autoclave provided with an agitator, heated at a rate of 3° C./min. to 440° C. under an initial hydrogen pressure of 100 kg/cm$^2$.G and then maintained at this temperature for two hours, after which the heating was stopped and the resulting liquid product cooled to room temperature. The liquid product so obtained was distilled at 250° C./1 mmHg to remove the light fraction therefrom thereby obtaining a starting pitch in a yield of 53 wt.%. The thus obtained starting pitch had a softening point of 105° C. and a 10% content of quinoline-insoluble ingredients.

Then, 30 g of said starting pitch were heat treated at 400° C. under agitation for 9 hours while passing nitrogen at a flow rate of 600 ml/min. to the pitch, thereby to obtain a precursor pitch having a softening point of 293° C. and a 44% content of quinoline-insoluble ingredients. The yield of the thus obtained precursor pitch was 51 wt.%.

The precursor pitch was then treated in the same manner as in Example 1 to obtain pitch fibers of 12$\mu$ in diameter which were then infusibilized, carbonized and graphitized under the same treating conditions as used in Example 1 thereby to obtain carbon fibers having a 10μ diameter, a tensile strength of 260 kg/mm² and a tensile modulus of 42 ton/mm².

COMPARATIVE EXAMPLE 5

Seventy-five (75) ml of the same "tar QS portion" as used in Example 1 and 75 ml of the same coal liquefaction pitch as used in Example 2 were charged into a 300 ml autoclave provided with an agitator, heated at a rate of 3° C./min. to 425° C. under a pressure of 15 kg/cm².G and then maintained at this temperature for 3 hours, after which the heating was stopped and the resulting liquid product cooled to room temperature.

The thus obtained liquid product was distilled at 250° C./1 mmHg to distill off the light fraction thereby obtaining a starting pitch in a yield of 52 wt.%. The starting pitch so obtained had a softening point of 103° C. and a 15% content of quinoline-insoluble ingredients.

Then, 30 g of the starting pitch were heat treated at 400° C. under agitation for 6 hours while passing nitrogen at a flow rate of 600 ml/min. to the pitch, thereby to obtain a precursor pitch in a yield of 51 wt.%. The thus obtained precursor pitch had a softening point of 320° C. and a 50% content of quinoline-insoluble ingredients. The precursor pitch was melt spun in the same manner as in Example 5 to obtain pitch fibers of 13μ in diameter which were then treated under the same conditions as used in Example 5, thereby to obtain carbon fibers having a 12μ diameter, a tensile strength of 105 kg/mm² and a tensile modulus of 16 ton/mm².

What is claimed is:

1. A process for the production of carbon fibers in which a starting pitch is heat treated to obtain a precursor pitch which is melt spun to obtain precursor pitch fibers, the pitch fibers are infusibilized and the infusibilized pitch fibers are carbonized or graphitized, wherein the starting pitch is a specific one obtained by heat treating at least one member selected from the group consisting of coal tar and coal liquefaction pitch at a temperature of 400°–500° C. and a hydrogen pressure of at least 20 kg/cm² without the addition of a hydrogenation catalyst and further heating at a temperature of 340°–450° C. and a pressure up to atmospheric pressure under a stream of an inert gas.

2. A process for the production of carbon fibers in which a starting pitch is heat treated to obtain a precursor pitch which is melt spun to obtain precursor pitch fibers, the pitch fibers are infusibilized and the infusibilized pitch fibers are carbonized or graphitized, wherein the pitch is a specific one obtained by mixing 100 parts by volume of (1) at least one member selected from the group consisting of coal tar and coal liquefaction pitch with 10–200 parts by volume of (2) at least one nucleus-hydrogenated aromatic hydrocarbon of 2–3 rings to obtain a mixture, then heat treating the thus obtained mixture at a temperature of 370°–480° C. and a pressure of 2–50 kg/cm².G, without the addition of a hydrogenation catalyst and then heating at a temperature of 340°–450° C. at a pressure up to atmospheric pressure under a stream of an inert gas.

3. A process for the production of carbon fibers according to claim 1, wherein the coal liquefaction pitch is a pitch-like substance boiling at not lower than 200° C. obtained from depolymerization products produced by a coal liquefaction method comprising treating various kinds of coal in a hydrocarbon solvent at 350°–500° C. under a hydrogen pressure of 10–500 kg/cm².G.

4. A process according to claim 2, wherein the nucleus-hydrogenated aromatic hydrocarbon of 2–3 rings is naphthalene, indene, biphenyl, acenaphtylene, anthracene, phenanthren and a $C_{1-3}$ alkyl-substituted compound thereof, in each of which 10–100% of the aromatic nuclei has been hydrogenated.

5. A process according to claim 4, wherein 10–70% of the aromatic nuclei of the aromatic hydrocarbon has been hydrogenated.

6. A process according to claim 4, wherein the nucleus-hydrogenated aromatic hydrocarbon of 2–3 rings is decalin, methyldecalin, tetralin, methyltetralin, dimethyltetralin, ethyltetralin, isopropyltetralin, indane, decahydrobiphenyl, acenaphthene, methylacenaphthene, tetrahydroacenaphthene, dihydroanthracene, methylhydroanthracene, dimethylhydroanthracene, ethylhydroanthracene, tetrahydroanthracene, hexahydroanthracene, octahydroanthracene, dodecahydroanthracene, tetradecahydroanthracene, dihydrophenanthrene, methyldihydrophenanthrene, tetrahydrophenanthrene, hexahydrophenanthrene, octahydrophenanthrene, dodecahydrophenanthrene or tetradecahydrophenanthrene.

7. A process for the production of carbon fibers according to claim 2, wherein the coal liquefaction pitch is a pitch-like substance boiling at not lower than 200° C. obtained from depolymerization products produced by a coal liquefaction method comprising treating various kinds of coal in a hydrocarbon solvent at 350°–500° C. under a hydrogen pressure of 10–500 kg/cm².G.

* * * * *